US006918680B2

(12) United States Patent
Seeberger

(10) Patent No.: US 6,918,680 B2
(45) Date of Patent: Jul. 19, 2005

(54) RETRACTABLE LIGHT & SOUND SYSTEM

(76) Inventor: James T. Seeberger, 14945 Lake Crossing Rd., Olathe, KS (US) 66547

( * ) Notice: Subject to any disclaimer, the term of this patent is extended or adjusted under 35 U.S.C. 154(b) by 173 days.

(21) Appl. No.: 10/307,177

(22) Filed: Nov. 29, 2002

(65) Prior Publication Data

US 2004/0105255 A1 Jun. 3, 2004

(51) Int. Cl.[7] ..... F21S 8/00

(52) U.S. Cl. ..... 362/150; 362/147; 362/152; 362/249; 362/250; 362/287; 362/285; 362/427; 362/428; 362/385; 362/233; 362/86; 362/276; 362/802

(58) Field of Search ..... 362/150, 147, 362/152, 249, 250, 287, 285, 427, 428, 386, 385, 233, 86, 276, 802, 286, 272

(56) References Cited

U.S. PATENT DOCUMENTS

| | | | | |
|---|---|---|---|---|
| 1,595,194 A | | 8/1926 | Hotchin | |
| 1,908,131 A | | 5/1933 | Doane | |
| 3,251,985 A | | 5/1966 | Krupnick | |
| 3,569,691 A | * | 3/1971 | Tracy | 362/233 |
| 3,692,993 A | | 9/1972 | Robinson | |
| 4,128,863 A | | 12/1978 | Premetz | |
| 4,302,800 A | | 11/1981 | Pelletier | |
| 4,424,555 A | | 1/1984 | Krubsack et al. | |
| 4,760,507 A | | 7/1988 | Lasker et al. | |
| 4,928,216 A | | 5/1990 | Carr | |
| 5,003,441 A | | 3/1991 | Crowe et al. | |
| 5,003,442 A | | 3/1991 | Gallo | |
| 5,142,463 A | | 8/1992 | Panagotacos et al. | |
| 5,230,559 A | | 7/1993 | Porter | |
| 5,311,411 A | | 5/1994 | Garolfi | |
| 5,359,506 A | | 10/1994 | Koleno | |
| 5,404,279 A | | 4/1995 | Wood | |
| 5,510,966 A | * | 4/1996 | Konecny | 362/249 |
| 5,594,628 A | | 1/1997 | Reuter | |
| 5,816,687 A | | 10/1998 | Tapp | |
| 6,019,488 A | | 2/2000 | Hastings | |
| 6,050,709 A | | 4/2000 | Hastings | |
| 6,224,232 B1 | | 5/2001 | Rodriguez | |
| 6,309,086 B1 | | 10/2001 | Tomlinson | |

* cited by examiner

*Primary Examiner*—Stephen Husar
*Assistant Examiner*—Bertrand Zeade
(74) *Attorney, Agent, or Firm*—Mark E. Brown

(57) ABSTRACT

A retractable light/sound system for mounting on the eave of a structure includes a housing and an output subassembly. A hinge pivotably interconnects the housing and the output subassembly whereby the latter is pivotable between a retracted/stored position and an extended/display position. The output subassembly includes multiple lights and/or loudspeakers and provides output in response to input power and/or control signals from any control subsystem, which can include a microprocessor adapted for preprogramming to activate the output components in response to certain, predetermined input source conditions. The system is adapted for mounting on or in soffits, or on building fascias integrally with gutters.

8 Claims, 8 Drawing Sheets

RETRACTABLE LIGHT & SOUND SYSTEM

BACKGROUND OF THE INVENTION

1. Field of the Invention

The present invention relates generally to architectural light and sound systems, and in particular to a system with a retractable light/audio output subassembly adapted for interior or exterior mounting on a structure, such as at or near the eaves of a residential, commercial, industrial or institutional building.

2. Description of the Prior Art

Lighting systems are available in a wide variety of configurations, which are designed to meet the requirements of particular applications. For example, architectural applications often involve both functional and aesthetic requirements. Both interior and exterior lighting can be designed to provide predetermined levels of illumination. For aesthetic purposes, lighting is often designed to enhance the visual appeal of a structure by providing high-visibility decoration.

Decorative lighting can be associated with a theme. For example, the custom and practice of decorating residential and commercial structures with strings of lighting near Christmastime is well-established. The festive effects are enjoyed by many. For commercial building owners and managers, such lighting can perform a commercial purpose by attracting customers and showing community involvement.

Other "themes" that can be marked by decorative lighting include patriotic and national events, vacations and holidays. For example, the Fourth of July is commonly observed by displaying the national colors red, white and blue. Still further, flashing lights and repeating patterns, such as "chase" patterns, can be used to attract attention.

In addition to theme-related decorative lighting, an important objective of architectural lighting systems is to provide security. Exterior lighting is often designed to illuminate areas surrounding buildings. Occupants are thus provided with security during hours of darkness. A common type of architectural security lighting activates upon detecting people and objects around the building perimeter. Unauthorized intruders can thus be illuminated by sensor-activated spotlights.

Sound systems have also been incorporated into structures. Like lighting, audio communication can both entertain, e.g. with piped music, and serve a security purpose, such as an alarm in a security system.

Installing and maintaining architectural light and sound systems can present significant difficulties and costs. For example, periodic installation and removal are commonly practiced with theme-related lighting, such as Christmastime lights. Adverse weather can present difficulties, particularly since inclement conditions are often encountered during the year-end holiday season. Installation, removal and maintenance often necessitate working from ladders at substantial heights. Another problem associated with exterior lighting and sound systems relates to damage and deterioration from exposure to the elements. For aesthetic purposes, lighting and sound systems are often removed or concealed during periods of nonuse. In the case of seasonal, theme-related lighting, the use periods may extend for only a few weeks, after which they are removed and stored, all at considerable inconvenience and expense.

These problems have been addressed by providing reconfigurable lighting systems. Prior art examples include those shown in the Robinson U.S. Pat. No. 3,692,993; Konecny U.S. Pat. No. 5,510,966 and Tapp U.S. Pat. No. 5,816,687. However, none of the previous architectural lighting systems includes the advantages and features of the present invention.

SUMMARY OF THE INVENTION

In the practice of the present invention, a retractable light and/or sound system is provided that includes a housing adapted for mounting on or in a structure and a retractable light/sound output subassembly. The housing can be concealed within a soffit or surface-mounted at any desired interior or exterior location, such as under an eave. The light/sound output subassembly comprises a raceway mounting multiple, spaced lights and/or loudspeakers and is movable between retracted/storage and extended/display positions. Retraction and extension can be accomplished by a motorized or manual mechanism. The functions of the system can be controlled by a microprocessor receiving various inputs and preprogrammed to provide various lighting and sound effects in response.

DETAILED DESCRIPTION OF THE PREFERRED EMBODIMENTS

I. Introduction and Environment

Figure 1:
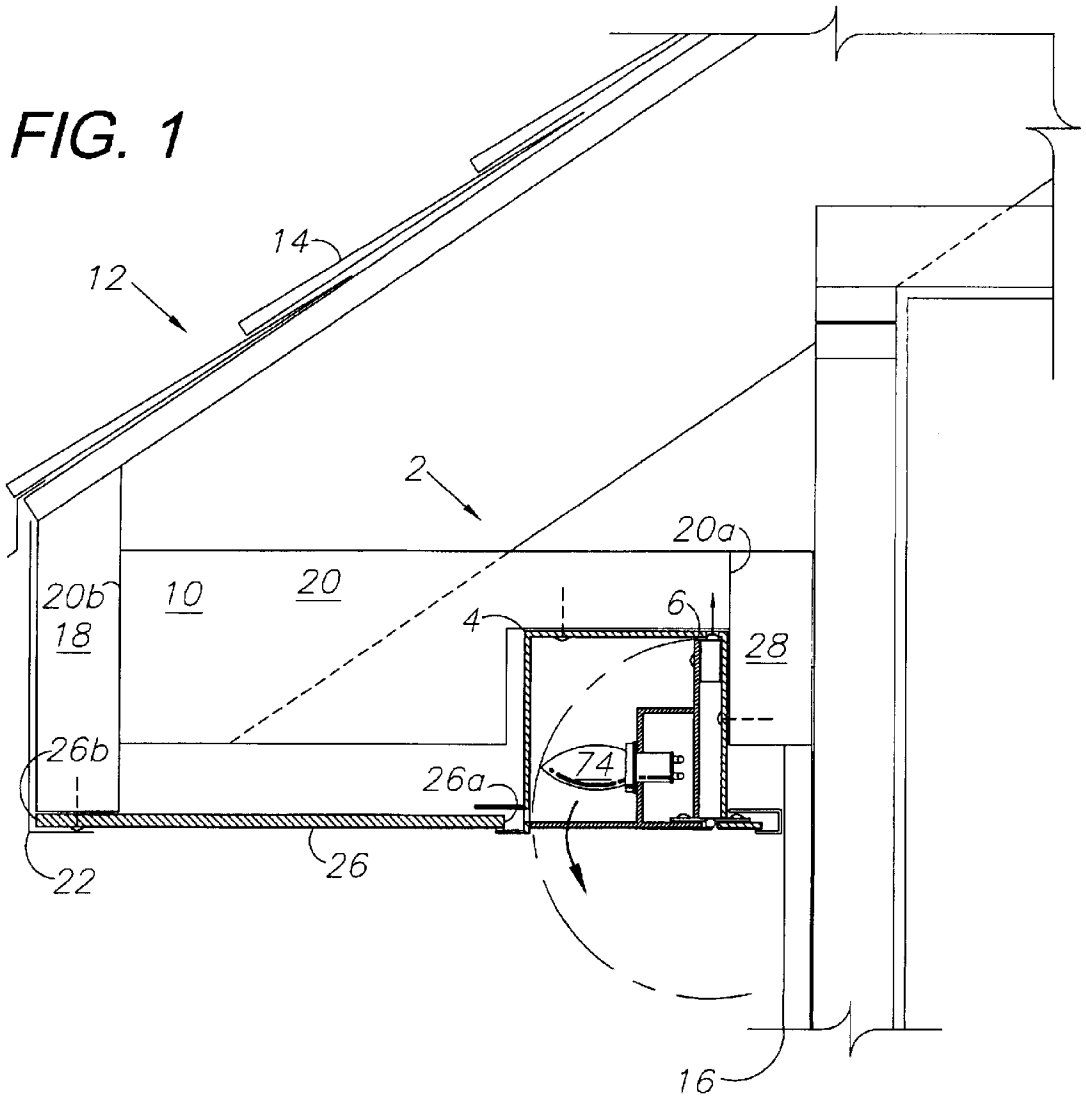
FIG. 1 is a cross-sectional view of a retractable lighting/sound system embodying the present invention, shown recessed into an eave of a structure with a light/sound output subassembly thereof retracted.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, up, down, front, back, right and left refer to the invention as oriented in FIG. 1. The words "inwardly" and "outwardly" refer to directions toward and away from, respectively, the geometric center of the embodiment being described and designated parts thereof. Said terminology will include the words specifically mentioned, derivatives thereof and words of similar import.

II. Preferred Embodiment Light/Sound System 2

Referring to the drawings in more detail, the reference numeral 2 generally designates a light/sound system embodying the present invention. The system 2 generally comprises a housing 4, an output subassembly 6 and a control subsystem 8.

Without limitation on the generality of useful applications of the light/sound system 2, it is shown mounted in the cave 10 of a new or existing structure 12 including a roof 14 supported by an exterior wall 16. The roof 14 terminates distally at a fascia header 18, which is mounted on lookout rafters 20 and is covered by a fascia cover 22. A soffit 24 includes a soffit panel 26 captured by the housing 4 at its inner edge 18*a* and mounted on the underside of the fascia header 18 at its outer edge 18*b*. The soffit panel 26 can comprise any suitable material, including, but not limited to, steel, aluminum, vinyl and wood.

Each lookout rafter 20 includes an inner end 20*a* attached to a ledger board 28 mounted on the exterior wall 16 and an outer end 20*b* attached to the fascia header 18. Each lookout rafter 20 includes a notch 30, which is located at its inner end 20*a* and is sized to receive the housing 4.

The housing 4 has a generally channel-shaped configuration with an inner/back wall 32, an outer/front wall 34, a top 36 and a receiver 38, which is open downwardly at an opening 40. An inner/back flange 42 extends rearwardly from the back wall 32 and is captured in a soffit channel 44 mounted on the structure exterior wall 16. A front soffit channel 46 extends forwardly/outwardly from the housing front wall 34 and captures the soffit panel inner edge 26*a*. The housing 4 can be attached to the eave 10 in any suitable manner. For example, mechanical fasteners 48, such as nails or screws, can extend through openings in the back wall 32 and the top 34 and into the ledger board 28 and the lookout rafters 20 respectively. Other suitable fasteners can also be used.

The output subassembly 6 generally comprises a raceway 52 with a longitudinally-extending passageway 54 accessible through bulb openings 56 formed in a raceway face 58. First and second raceway extensions 60, 62 extend from the raceway 52 and form a substantially 90° right dihedral angle with respect to each other. A hinge opening 64 is formed near the pivot corner 66 of the raceway 52. A hinge 68 extends therethrough and is mounted on the raceway 52 within the passageway 54, and on the housing inner/back flange 42. Various alternative hinge designs can be successfully employed with the present invention. For example, hinge parts can be integrally formed with the housing 4 and the raceway 52 whereby they snap together in a pivotable relationship. Individual hinges, or continuous piano-type hinges can be used. Moreover, the hinge can comprise a length of flexible material or some other construction adapted for allowing the output subassembly 6 to pivot with respect to the housing 4. A trim piece 69 is placed over the hinge 68 for concealing same and partially enclosing a gap formed between the housing 4 and the raceway 52.

Figure 2:
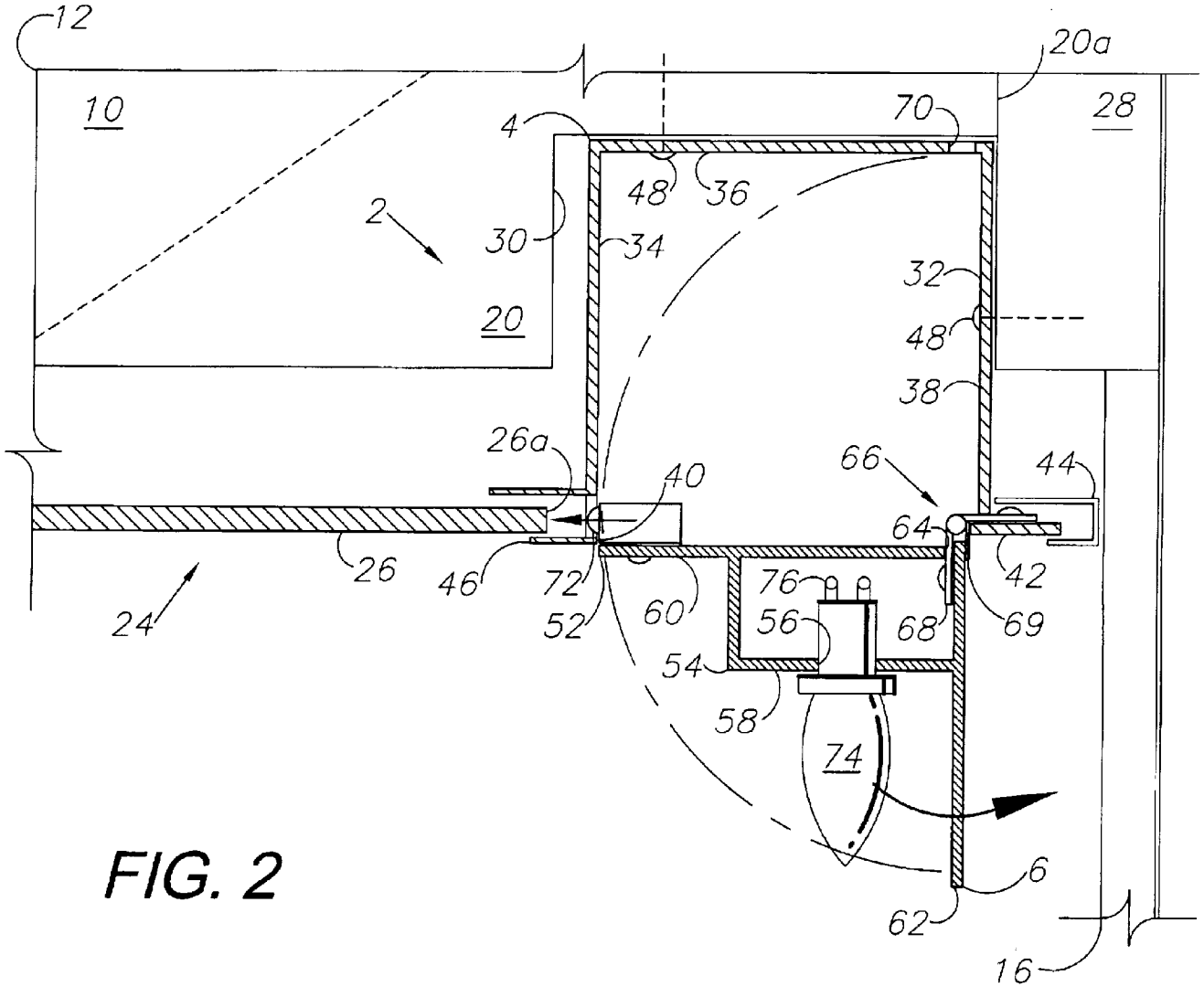
FIG. 2 is an enlarged cross-sectional view thereof, shown with the light/sound output subassembly extended.

Various fasteners can be used to releasably retain the raceway in its retracted and extended positions. For example, a detent ball-and-receiver combination is shown and includes detent receivers 70 formed in the housing outer wall 34 and the top 36. A detent plunger 72 is mounted on the second extension 62 and releasably engages the detent receivers 70 when the output subassembly 6 is in its fully-retracted and fully-extended positions (FIGS. 1 and 2 respectively). The fastener retainers can also comprise clips of various types, magnets (permanent and electrical), snaps, springs, solenoids and hydraulics. Moreover, the output subassembly 6 can be extended and retracted with a power or other device, such as an electric motor, whereby the detents 70, 72 may be unnecessary. Other suitable actuating devices include manual cranks, winches, rods, hydraulics, etc.

Output components 74 are received in the passageway openings 56 and extend generally outwardly and downwardly from the raceway face 58 with the output subassembly 6 in its retracted and extended positions respectively. Although a decorative light 74 is shown, the output components can comprise a wide variety of lights and audio components. For example, the lights can comprise any suitable size, style and color, including light emitting diodes (LEDs), fluorescent, incandescent, fiber-optic, etc. Suitable audio output component(s) include loudspeakers, alarms, buzzers, chimes, etc. Electrical wiring 76 can be run through the passageway 54 for interconnecting the output components 74 and the control subsystem 8.

The system 2 can be made with any suitable material and production procedure. For example, steel, aluminum, plastic (e.g., PVC and other suitable plastics) can be used. The materials can be continuously extruded to provide housings and raceways of various lengths. Also, they can be fabricated from sheet metal using conventional bending procedures, and the parts can be fastened together in a suitable manner, including welding, riveting, screwing, etc.

III. First Modified Embodiment Surface-Mounted Light/Sound System 102

Figure 3:
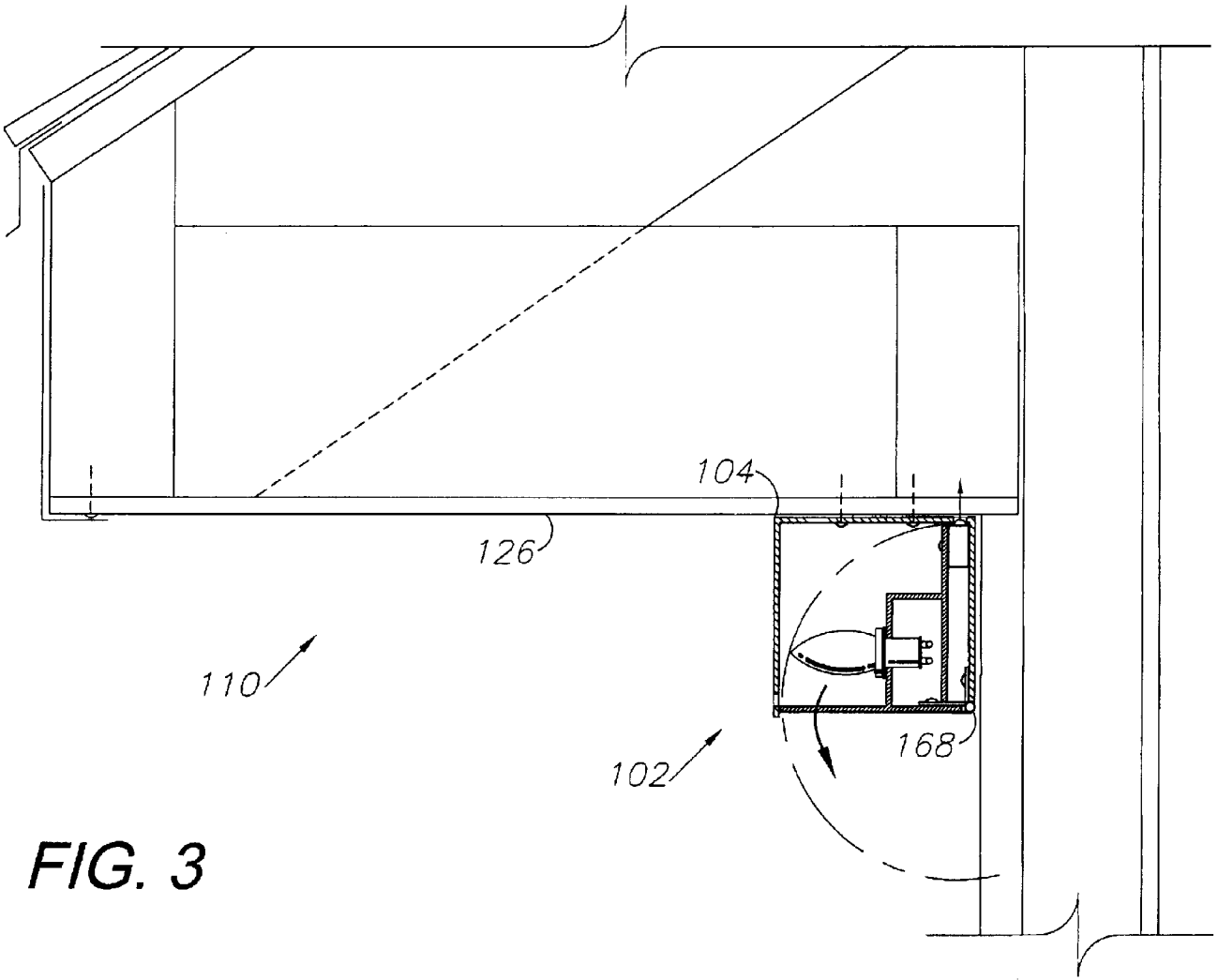
FIG. 3 is a cross-sectional view of a first modified embodiment, shown surface-mounted on a soffit.
Figure 4:
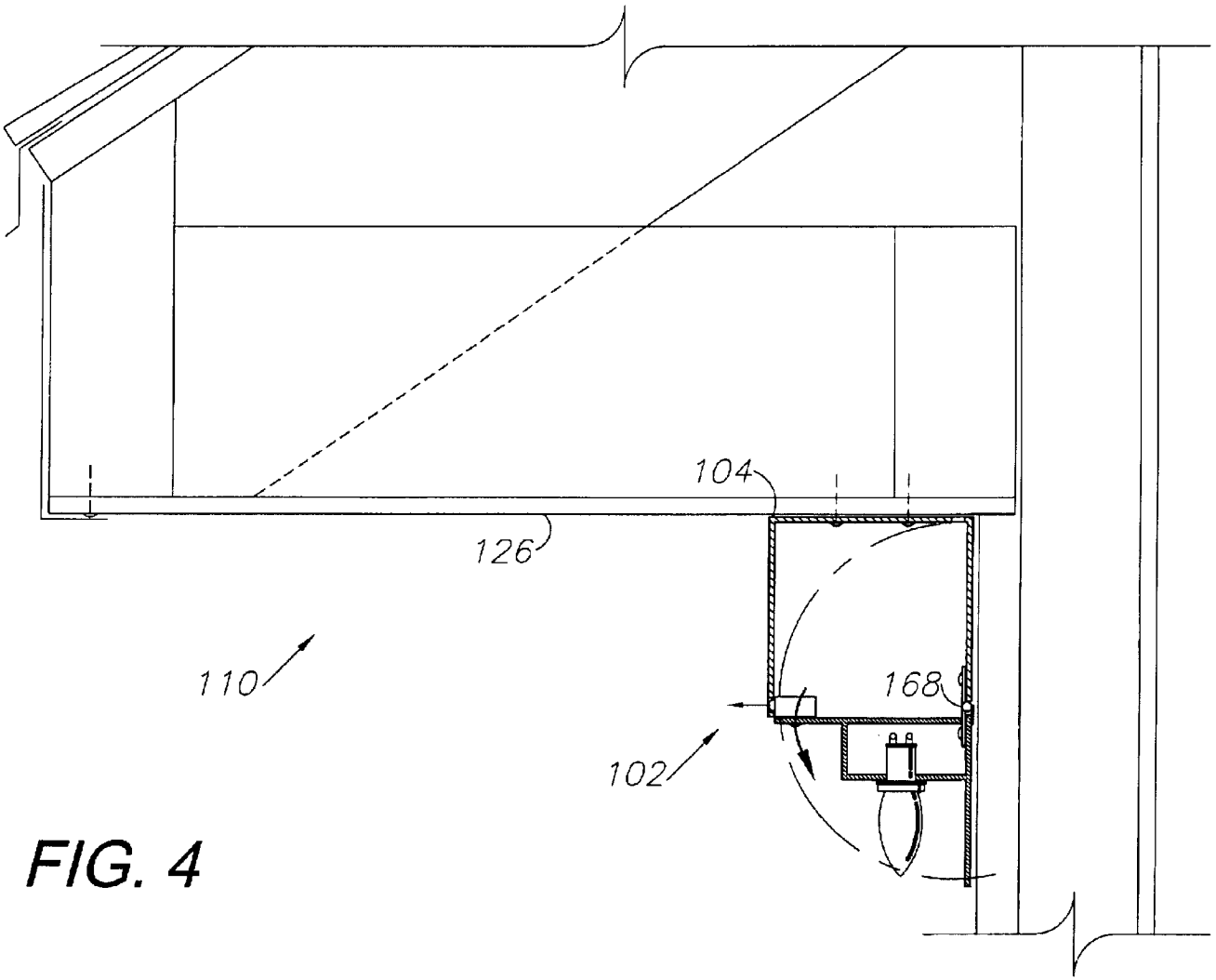
FIG. 4 is a cross-sectional view thereof, shown with the light/sound output subassembly extended.

FIGS. 3 and 4 show a first modified embodiment light/sound system 102 adapted for mounting on a surface, such as a soffit panel 126 under an eave 110. The system 102 includes a modified housing 104 with a modified hinge 168 configuration. It will be appreciated that the system 102 is adapted for mounting on various surfaces. For example, it can be located in various positions on the soffit panel 126 to achieve various desired aesthetic effects.

IV. Second Modified Embodiment Light/Sound System and Integral Gutter 202

Figure 5:
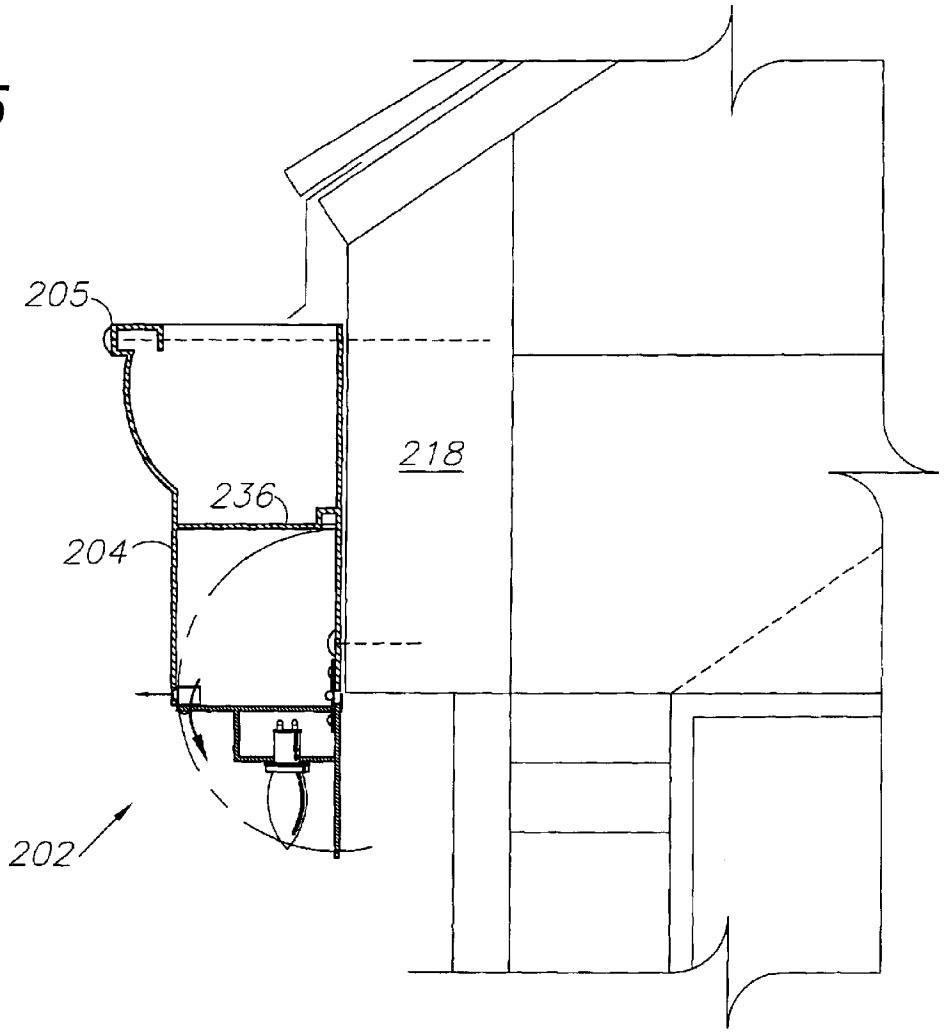
FIG. 5 is a cross-sectional view of a second modified embodiment wherein the light/sound output subassembly is integrally formed with a gutter.

FIG. 5 shows a second modified embodiment light/sound system 202 wherein a housing 204 is integrally formed with a gutter 205; the housing top 236 forming the bottom of the gutter 205. The system 202 can be mounted on a fascia header 218 as shown, or at various other suitable locations on a structure.

V. Third Modified Embodiment Double Light/Sound System 302

Figure 6:
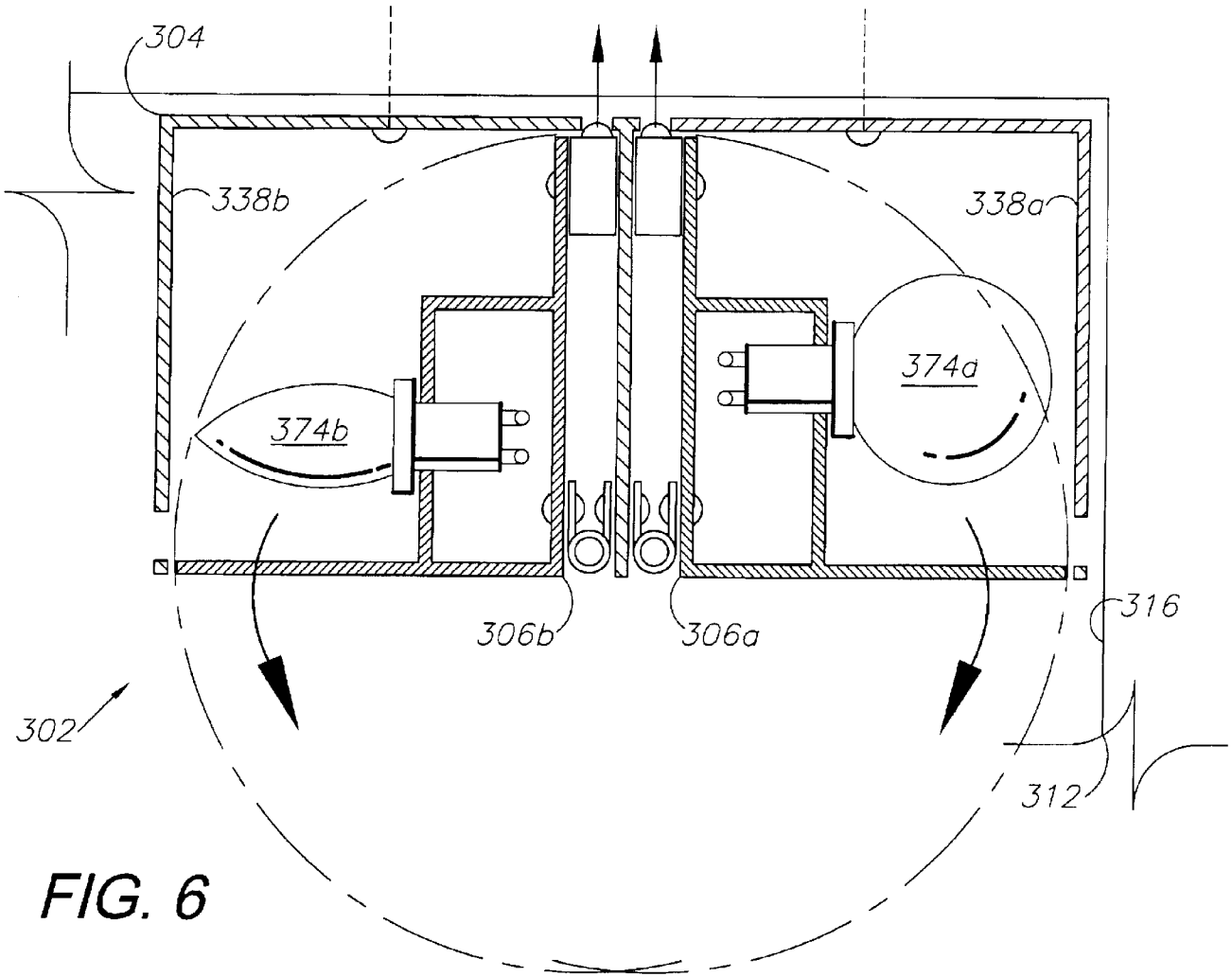
FIG. 6 is a cross-sectional view of a third modified embodiment with first and second light/sound output subassemblies.
Figure 7:
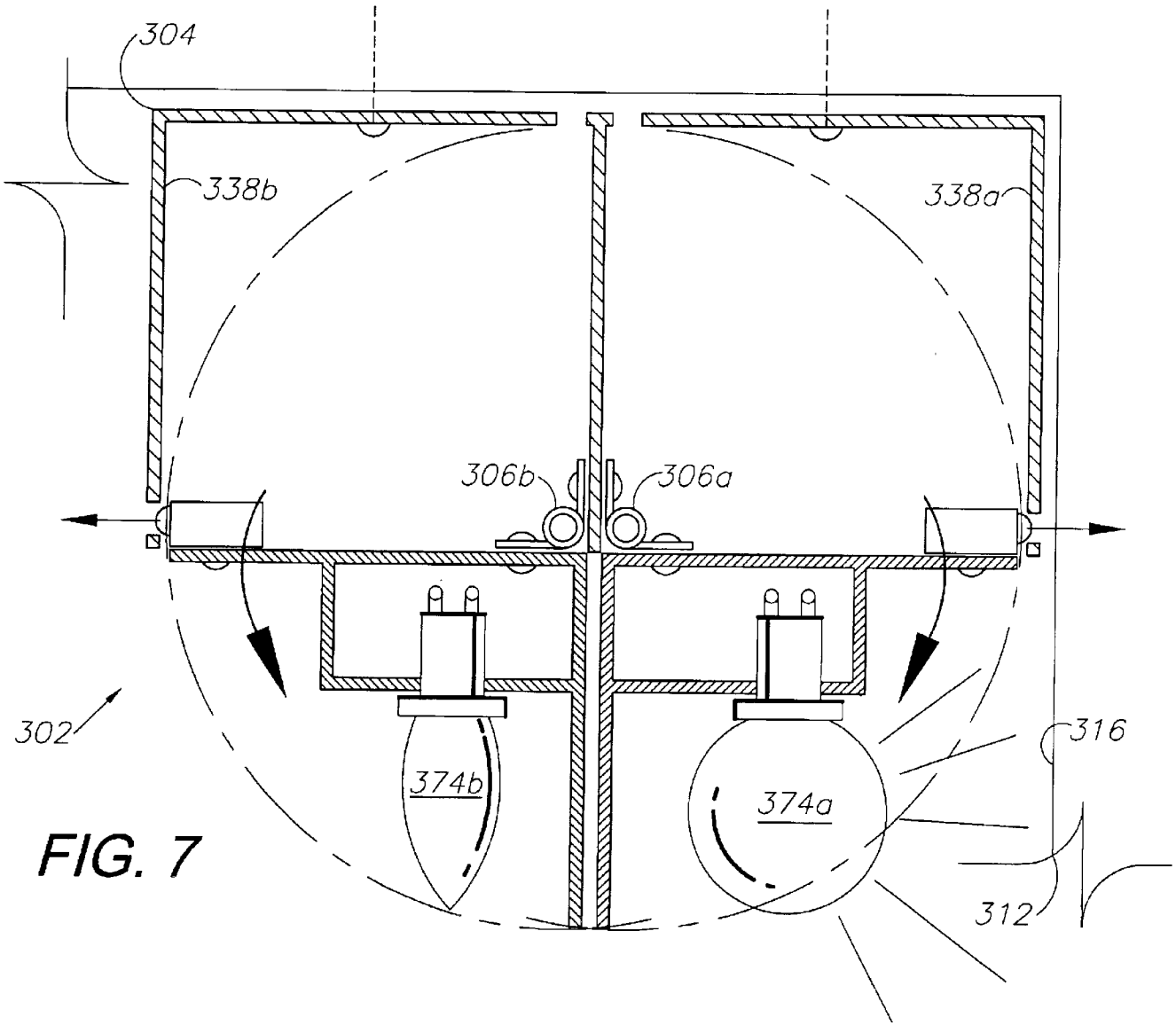
FIG. 7 is a cross-sectional view thereof, shown with the light/sound output subassemblies extended.

FIGS. 6 and 7 show a third modified embodiment of the present invention comprising inner and outer output subassemblies 306*a,b* retractably mounted in a modified housing 304 with first and second receivers 338*a,b*. First and second output components 374*a,b* can be chosen for desired output effects. For example, the first/outer components 374*a* can comprise decorative, seasonal-type lights. The second/inner components 374*b* can illuminate a portion of the structure 312, such as an interior or exterior wall 316, with a "wall washer" lighting effect. The output subassemblies 306*a,b* can be extended, retracted and operated independently or in conjunction with each other.

VI. Control Subsystem 8

Figure 8:
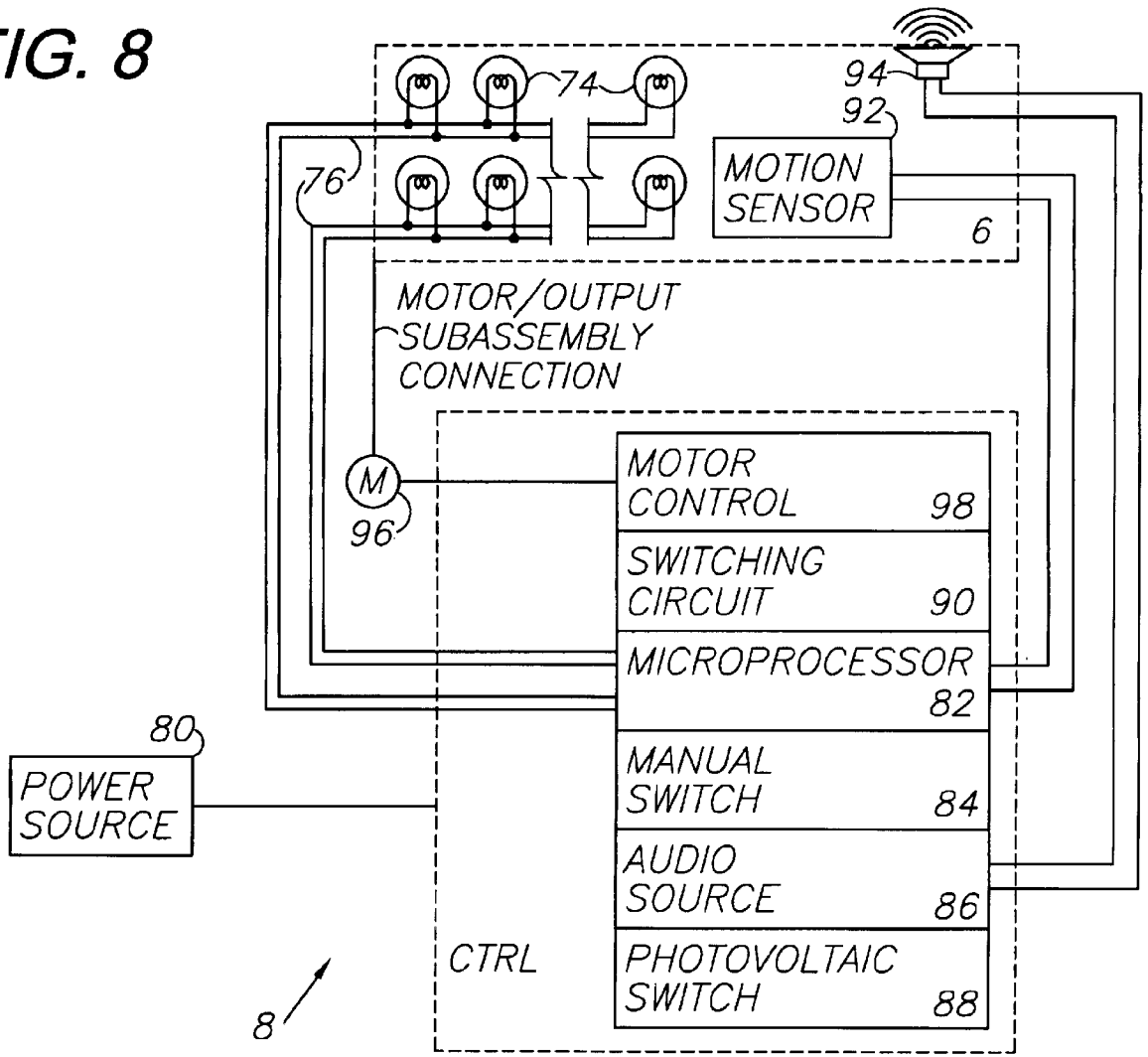
FIG. 8 is a schematic diagram of the system, particularly showing a control subsystem thereof.

FIG. 8 is a schematic diagram of the system 2, particularly showing a control system 8 thereof. A power source 80 can comprise the host building electrical power, or a stand-alone battery or generator power source. The control subsystem 8 includes a microprocessor 82 connected to a manual switch 84 for manually, selectively extending, retracting and operating the output subassembly. An audio source 86 can provide any suitable audio output, such as conventional public address (PA) music and paging, alarm, etc. A photovoltaic switch 88 can respond to conditions of light and darkness for automatic control through the microprocessor 82. A switching circuit 90 can provide various output control signals, including varying lighting displays, flashing patterns, "chase" patterns, blinking, etc. A motion sensor 92 can be associated with the output subassembly 6 and can actuate the lights in response to sensing motions, such as those associated with intruders. The system 2 can thus serve a security lighting function.

The output subassembly 6 includes both electrical light output components 74 and a loudspeaker 94. The output signals to the output components 74, 94 can be controlled by the microprocessor 82. A motor 96 is operably connected to the output subassembly 6 for extending and retracting same in response to control signals from a motor control 98 connected to the microprocessor 82. Alternatively, operation of the output subassembly 6 can be accomplished manually, hydraulically, with a handcrank or with a suitable extended rod adapted for engaging the output subassembly 6 or an operating mechanism attached thereto.

It is to be understood that the invention can be embodied in various forms, and is not to be limited to the examples discussed above.

Having thus described the invention, what is claimed as new and desired to be secured by Letters Patent is:

1. In combination with a building including an eave with a soffit having lookout rafters and a soffit panel mounted on the underside of said lookout rafters, the improvement of a lighting system adapted for mounting in said soffit, which includes:

a longitudinally-extending, downwardly-open opening formed in said soffit and including notches formed in said lookout rafters;

a housing adapted for mounting in said opening at least partly in said lookout rafter notches and including inner, outer and upper housing walls forming a downwardly-open receiver;

multiple mechanical fasteners extending through said housing walls and into said soffit rafters for mounting said system in said eave;

a longitudinally-extending output subassembly including a raceway with a wiring passageway, multiple lights mounted on said raceway, a wiring harness extending through said passageway and connected to said lights;

a hinge connected to the housing and the raceway, said hinge defining a longitudinally-extending pivotal axis located in proximity to said soffit panel;

said output subassembly being pivotable about said pivotal axis between a retracted/stored position substantially within said housing receiver and an extended/display position extending downwardly from said housing with said output component exposed; and a control subsystem including a motor operably connected to said output subassembly and adapted for extending and retracting same, said control subsystem including a microprocessor programmable to automatically operate said motor and multiple inputs adapted for sensing predetermined conditions for extending and retracting said output subassembly and selectively illuminating said lights.

2. The invention according to claim 1, wherein said output subassembly includes a loudspeaker mounted on said raceway and said control subsystem includes an audio source connected to said loudspeaker.

3. The invention according to claim 1 wherein said control subsystem includes a photovoltaic switch connected to said microprocessor.

4. The invention according to claim 1 wherein said microprocessor or is preprogrammed to call said lights to flash in a predetermined pattern.

5. The invention according to claim 1 wherein said control subsystem includes a motion sensor adapted to extend said output subassembly and activate said output component in response to sensing motion.

6. The invention according to claim 1 wherein said housing and said raceway are extruded.

7. The invention according to claim 1 wherein said hinge comprises first and second pivotably interlocking components integrally formed with said housing and said raceway respectively.

8. The invention according claim 1 wherein said output subassembly is connected to a power source associated with the structure on which said system is mounted.

* * * * *

UNITED STATES PATENT AND TRADEMARK OFFICE

CERTIFICATE OF CORRECTION

PATENT NO. : 6,918,680 B2
DATED : July 19, 2005
INVENTOR(S) : James T. Seeberger It is certified that error appears in the above-identified patent and that said Letters Patent is hereby corrected as shown below:

Title page,
Item [76], Inventors, change “Olathe” to -- Wamego --.

Signed and Sealed this

Eleventh Day of October, 2005

JON W. DUDAS
*Director of the United States Patent and Trademark Office*